US005259513A

United States Patent [19]

Tähkänen et al.

[11] Patent Number: 5,259,513

[45] Date of Patent: Nov. 9, 1993

[54] METHOD AND A DEVICE FOR SORTING RETURNABLE BOTTLES, CANS AND OTHER RETURNABLE PACKAGES

[75] Inventors: Pekka Tähkänen, Heinola; Petri Komonen, Villähde; Samuli Mäkinen, Heinola, all of Finland

[73] Assignee: Halton Oy, Finland

[21] Appl. No.: 801,714

[22] Filed: Dec. 2, 1991

[30] Foreign Application Priority Data

Dec. 5, 1990 [FI] Finland ..... 906017

[51] Int. Cl.[5] ..... B07C 5/00

[52] U.S. Cl. ..... 209/566; 209/522; 209/657; 209/586

[58] Field of Search ..... 209/522-524, 209/559, 564, 565, 566, 586, 657

[56] References Cited

U.S. PATENT DOCUMENTS

| | | | |
|---|---|---|---|
| 2,862,617 | 12/1958 | Brown | 209/566 |
| 3,141,540 | 7/1964 | Burkhardt | 209/566 |
| 3,270,882 | 9/1966 | Perotto | 209/566 |
| 3,574,328 | 4/1971 | Holmes | 209/566 |
| 3,652,828 | 3/1972 | Sather et al. | 209/566 |
| 4,132,314 | 1/1979 | von Beckmann et al. | 209/565 |
| 4,248,389 | 2/1981 | Thompson et al. | 209/564 |
| 4,304,981 | 12/1981 | Gappa | 209/566 |
| 4,386,708 | 6/1983 | Sieverin | 209/566 |
| 4,549,662 | 10/1985 | Schoenig, Jr. et al. | 209/654 |
| 4,711,357 | 12/1987 | Langenbeck et al. | 209/565 |
| 4,776,466 | 10/1988 | Yoshida | 209/565 |

FOREIGN PATENT DOCUMENTS

| | | | |
|---|---|---|---|
| 946616 | 1/1964 | United Kingdom | 209/565 |

*Primary Examiner*—Robert P. Olszewski
*Assistant Examiner*—Steven M. Reiss
*Attorney, Agent, or Firm*—Steinberg & Raskin

[57] ABSTRACT

The invention relates to a method and device for sorting returnable bottles, cans and other returnable packages. In the method, a returnable package is transferred by means of a transferring device to an identification device having a data processing unit and a data storage unit in which data concerning different types of acceptable package forms and/or package colors are preregistered. An identification index corresponding to form-/color is given to the identified package and the index is transferred to a pushdown storage of a first sorter located after the identification device, to a first lowermost free storage location of the pushdown storage. The identification index is compared with a specific index related to the sorter. If the identification index corresponds to the specific index of the sorter, a sorting is performed with the sorter and the returnable package is transferred away from a main conveyor. If the index does not correspond to the specific index of the sorter, the identification index is transferred to the first lowermost free storage location of a pushdown storage of a next sorter.

12 Claims, 4 Drawing Sheets

METHOD AND A DEVICE FOR SORTING RETURNABLE BOTTLES, CANS AND OTHER RETURNABLE PACKAGES

BACKGROUND OF THE INVENTION

The invention relates to a method and a device for sorting returnable bottles, cans and other returnable packages.

Sorting arrangements are known in prior art, in which a returnable bottle is led from a belt conveyor via different gates or other guides to a storage station determined by the sorting. In the arrangements according to prior art, the onesidedness of the sorting can be regarded as a disadvantage. In known devices, it has not been possible to find a solution to how the sorting could occur flexibly after the identification of the packages in such a way that the sorter would automatically transfer the package which has entered at the station to its own storage station dependably on the identified profile data.

It is therefore an object of the present invention to provide a solution to the above-mentioned problems.

SUMMARY OF THE INVENTION

In accordance with the above objective and others, the present invention is directed to the discovery that it is useful to form such a post-identification package sorting system, in which the package is automatically transferred o the basis of the profile data to its own storage station. An ejector located at the storage station receives the data about the identified profile by means of series connected storage circuits.

In the package sorting system of the present invention, when the package form and/or package color is identified, an identification index corresponding to the form/color concerned is given to the identified package and the index is transferred to a pushdown storage of a first sorter located after the identification device, and on to the first lowermost free storage location. The above-mentioned identification index is compared with the specific index related to the sorter, and if this identification index corresponds to some specific index of the sorter, a sorting is performed with the sorter and the returnable package is transferred away from the main conveyor. If this index does not correspond to the specific index of the sorter, this identification index is transferred to the first lowermost free storage location of the pushdown storage of the sorter.

The inventive device for sorting returnable bottles, cans or other returnable packages comprises a pushdown storage of a series bus connected with each sorter and storage register locations in each pushdown storage. The identification data transfers to a first sorter in connection with the identification device, to the lowermost or first record of the storage register of the pushdown storage. A conveyor transfers the identified returnable package to the first sorter. A sensor device senses the entry of the returnable package at the sorter, whereby the index data in the lowermost storage location of the pushdown storage of the sorter is compared with the specific index of the sorter. If a correspondence is observed between the identification index of the pushdown storage and some specific index of the sorter, a sorting is accepted at said identified package and the sorter performs the sorting.

BRIEF DESCRIPTION OF THE DRAWINGS

The following drawings are illustrative of embodiments of the invention and are not meant to limit the scope of the invention as encompassed by the claims.

DETAILED DESCRIPTION

Figure 1:
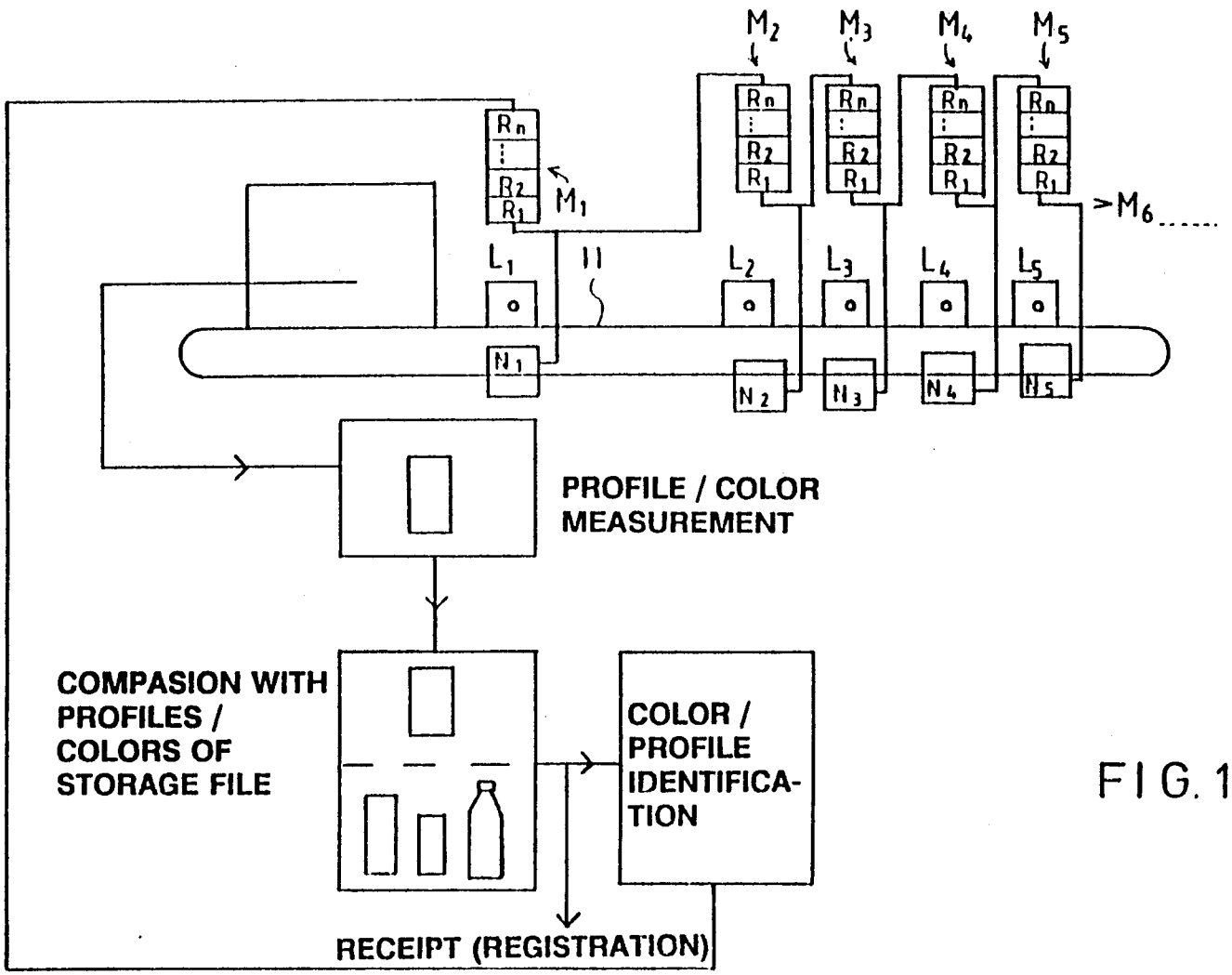
FIG. 1 shows principally the construction and operation of the inventive package receiving device.

FIG. 1 illustrates as a block diagram representation the operation of a preferred embodiment of the inventive device.

In the device shown in FIG. 1, the form and/or color of a returned package, such as a bottle, is identified and the said form is compared with the known forms and/or colors stored in the central processor. When the form is identified, each returnable product is given an index corresponding to its form and/or color, and said index data is transferred to the storage register in the sequential communications bus in such a way that the data transfers to the first lowermost free storage location $R_1$, $R_2$, . . . of a pushdown storage $M_1$.

When the returnable product enters, as shown in FIG. 1, at a first sorter $L_1$, the sorter receives the data about the entry of the bottle and compares the sorter's own index with the register data located first in the storage register of the pushdown storage. If the index data are the same, the sorter performs a sorting operation and transfers the returnable can away from the conveyor track, e.g. to a parallel conveyor, or directly e.g. to a storage station V.

If at the pushdown storage space M of the sorter $L_1$, the record located first in its storage register $R_1$, does not correspond to the storage station $L_1$'s own index in the step when the data is read (i.e., when a sensor device senses the entry of the returnable product at its location), the actuator of the sorter $L_1$ is not activated and the first record of the storage register of said storage location transfers to the lowermost free storage location $R_1$, $R_2$, $R_3$ . . . of the pushdown storage of the next sorter $L_2$. When the returnable bottle now enters at the sorter, a similar comparison occurs between the record contained in the first storage location $R_1$ of the storage register of the pushdown storage $M_2$ of said storage location and the index related to the sorting station concerned. If the indexes correspond to each other, the sorter $L_1$ performs the sorting operation. Otherwise, said identification index of the storage register transfers to the lowermost free storage location $R_1$, $R_2$ . . . in the storage register of the pushdown storage $M_3$ of a next sorter $L_3$. Similarly, if a correspondence is observed between some specific index of said sorter $L_3$ and the identified index of the pushdown storage $M_3$ related to the returnable package, a sorting is performed by the sorter $L_3$.

FIG. 2-5 shows a profile identification method known per se and applied to the device.

Figure 2:
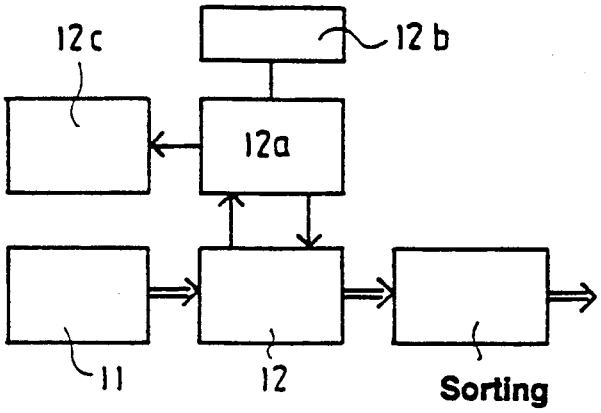
FIG. 2 shows as a block diagram of the inventive equipment.

As shown in FIG. 2, an equipment arrangement 10 comprises a transfer equipment 11 for transferring a returnable package P, an identification device 12 with its data processing unit 12*a* for identifying and accepting packages having certain forms, as well as a registration device 12*c* for registering the accepted packages. The transfer equipment 11 can be comprised e.g. of one or more belt conveyors, of a rotating tray conveyor, or generally of any conveyor suitable for transferring packages. The conveyor 11 may be arranged to transfer the packages horizontally and/or possibly vertically, but a horizontal transfer is regarded as the most suitable one in connection with the inventive bottle receiving device.

The identification device 12 preferably comprises the data processing unit 12*a* with its storage unit 12*b* and its registration unit 12*c*. The data processing unit 12*a* is provided with package forms accepted by the record of its storage unit 12*b*, i.e. the data about the package forms to be accepted may be entered into the file for comparing the information to be obtained about the form of the package to be monitored with the corresponding information about the package forms to be accepted. The registration device 12 registers the number of the packages to be accepted, possibly the sizes and/or the amount of money to be remunerated or returned.

Figure 3:
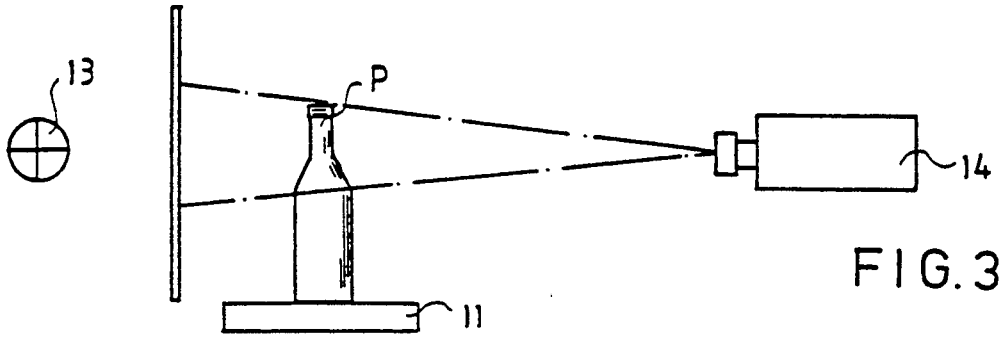
FIG. 3 shows, seen from the side, the construction of the package identification device connected to the package receiving device.
Figure 4:
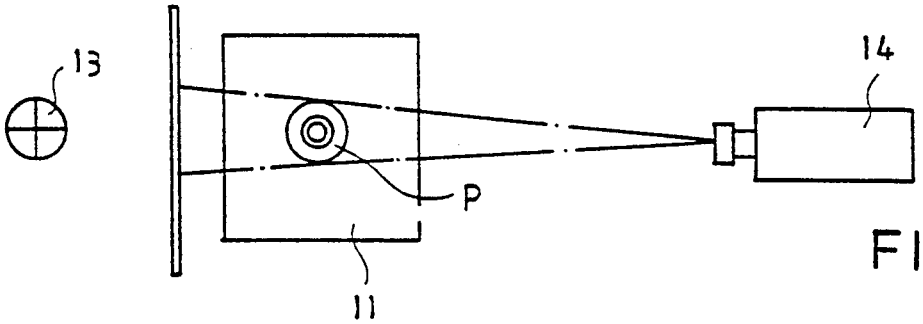
FIG. 4 shows the equipment of FIG. 3 seen from the top.

FIG. 3-4 shows as a principal schematic view of a certain identification device 12, which mainly comprises a stationary illuminator 13 for illuminating a package p, a detector 14 for monitoring the package and a conveyor 11 for transferring the package past the detector 14. The detector 14 is arranged to momentarily monitor the package, within time intervals, at line-like points, when the bottle is transferred (conveyed by the conveyor 11), past the detector in such a way that the line-like monitoring points provide information, e.g. at the bottle, at least about the form of the neck and the upper part of the package, i.e. the detector is arranged to take a so-called line picture of the bottle.

Figure 5:
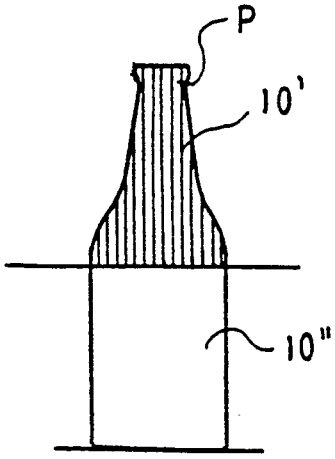
FIG. 5 shows the forming of a line picture of a package to be monitored with the identification device of FIG. 3 and 4.

When taking a line picture, the detector 14 thus takes line pictures of the package according to FIG. 5 at time intervals, when the conveyor transfer the package P past the detector 14. Line pictures can be taken at desired time intervals, i.e the line density of the picture can be adjusted in the desired manner according to the accuracy of the desired information. The doctor 14 changes the line picture information into electric impulses to be led to the data processing unit 12*a* in accordance with FIG. 2.

For example at the identification point of the bottles P, it is not necessary to take a line picture of the whole bottle, but it is generally sufficient to take a picture of an upper part 10' of the bottle in accordance with FIG. 5, since the specific features of the bottle types or models generally appear best at the upper part of the bottle. A lower part 10'' of the bottle then suitably remains unphotographed.

In FIGS. 3-4, a conventional line camera has been used as the detector 14, which is arranged to photograph a bottle moving past the camera laterally perpendicularly against the direction of the camera's objective at the area of the bottle neck by means of vertical line pictures at intervals of 1 mm. The identification device is programmed to measure the height of the bottle. The detector 14 may, when so desired, be arranged to take horizontal pictures of the bottle, whereby the conveyor is suitably arranged to transfer the bottle vertically for photographing the bottle at the desired height.

When the profile identification information has been received, it is compared with the pre-known profiles of different bottle types of the storage unit 12*b* of the data processing unit 12*a*, and if the identified profile form corresponds to some form pre-stored in the storage 12*b*, the returnable bottle is accepted and it is immediately given an index related to the profile form. Said index data is transferred to the pushdown storage $M_1$ of the first sorter $L_1$ located in the conveying direction of the bottle, to its first lowermost free storage location $R_1$ or $R_2$ . . .

FIGS. 2-5 show a certain profile identification equipment. However, it is not intended to limit the invention solely to the embodiment of the identification device known per se and shown in FIG. 1-5. The profile can be identified also by means of identification means of another type.

Figure 6A:
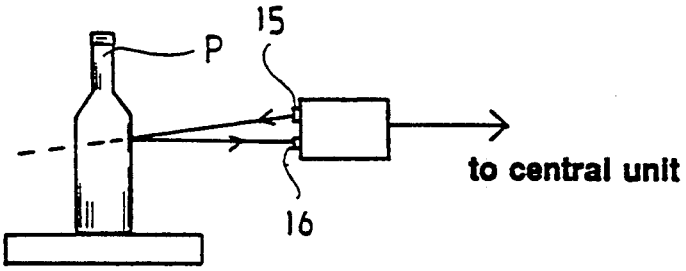
FIG. 6A and 6B show the color identification of a bottle.

FIG. 6A shows a package color identification equipment. According to the figure, a light beam is produced from a light source 15, and said light beam produced from the light source is caused to advance against the package, e.g. a bottle P, to be identified. Part of the light beam is reflected back to the receiver 16, whereby the color of the bottle may be identified by means of the reflected light beam. The received light beam is compared with preprogrammed identification signals corresponding to different shades and located in the storage circuit of the storage unit 12*b*. If a correspondence between the identified and reflected identification signal and the identification signal pre-stored in the storage register is observed, an identification index corresponding to the identification data is given to the bottle. Thus, in the inventive returnable-package handling, an identification index can be given to the returnable package, which index is based either on the package form and/or the package color.

Figure 6B:
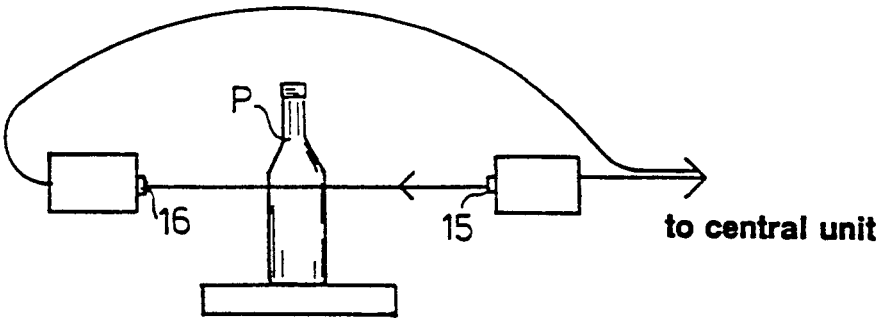

FIG. 6B shows the color identification equipment, a light beam produced from the light source 15 from behind the received bottle P with the receiver 16, and the data about the transmitted and received signal is processed in the color identification block of the central unit.

Figure 7:
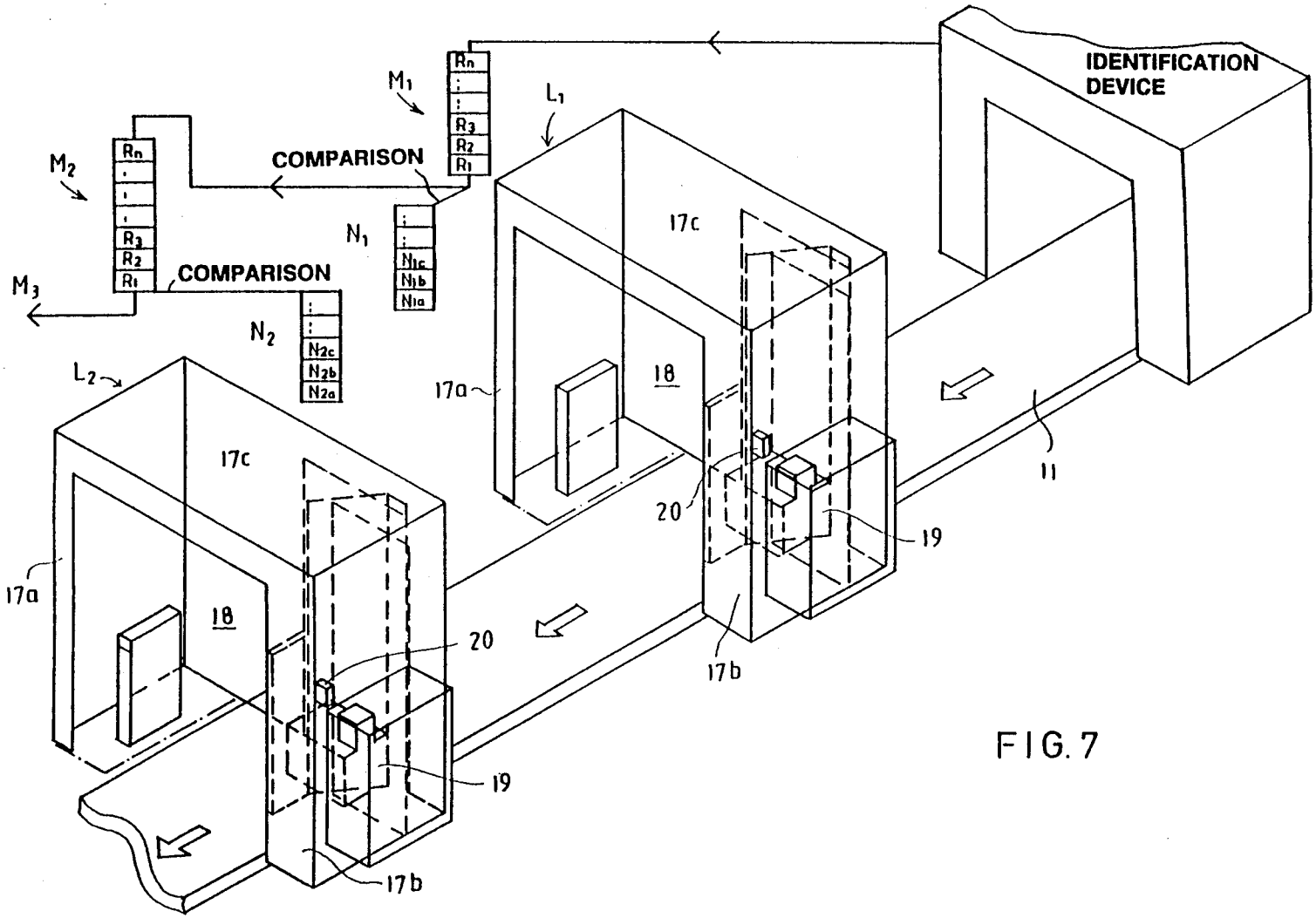
FIG. 7 shows as an axonometric view the inventive equipment and a transferrable sorting station.

FIG. 7 shows as a principal view as well as an axonometric representation the inventive equipment. In accordance with the invention, the sorters $L_1$, $L_2$, and $L_3$ . . . are located, as shown in the figure, after the profile/-color identification equipment itself in connection with the conveyor passage 11. Each sorter $L_1$, $L_2$, etc. comprises a frame 17, which rests freely on a base E. The frame 17 is a U-profile comprising leg portions 17*a* and 17*b* of the frame and a top frame section 17*c* connecting them with each other. Between said frame sections remain a gate 18, through which the conveyor belt is led. Each sorter $L_1$, $L_2$ etc. further comprises an actuator 19 performing the sorting, e.g. a solenoid or an actuating cylinder, preferably a pneumatic or hydraulic cylinder, by means of which a returnable package that has come to the actuator 19 is transferred to a second station, if the sorter performs the sorting, i.e. if the command from the sorting has been given to the actuator 19. Each sorter $L_1$, $L_2$, $L_3$ (three sorters are shown in the figure) may be freely transferred to the desired station on the conveyor passage, and the sorting point can thus be freely selected (e.g. the point on the conveyor belt 11, from which the package is transferred e g. to a second conveyor or directly to a storage station V).

Each sorter $L_1$, $L_2$, $L_3$ . . . further comprises a pushdown storage $M_1$, $M_2$, $M_3$ . . . related to the sorter and an identification index $N_{1a}$, $N_{1b}$, $N_{1c}$ . . . ; $N_{2a}$, $N_{2b}$, $N_{2c}$; $N_{3a}$, $N_{3b}$, $N_{3c}$ . . . Thus, there may be several specific indexes related to each sorter $L_1$, $L_2$, $L_3$ . . . Thus, the same sorter is capable of sorting packages of several types. The number of package types to be sorted with the same sorter corresponds to the specific indexes given to the sorter $L_1$, $L_2$, $L_3$ . . .

The arbitrary transfer of said sorter $L_1$, $L_2$ . . . to a station is made possible by an inventive usage of a series-connected bus of character strings, in which the microprocessor produces in the first storage register of the series-connected bus of character strings, in which the microprocessor produces in the first storage register of the series-connected bus data about the identified returnable package, e.g. a bottle, which receives an identification index related to a certain identified profile and/or color. Said data is thus stored in the pushdown storage of the storage register. The register storage locations are arranged in a pushdown list in such a way that the index of the first returned bottle is placed first (lowermost) in the storage register location. When a new identification index corresponding to a new identified bottle enters, it transfers to the lowermost position in the storage register and to the first position in said storage register, in which connection the register does not comprise in that step other indexes. The first storage register corresponds to the first sorting automaton and said sorting automaton also is provided with one or more indexes, which index(s) is related only to said sorting automaton. If it is desirable to sort the identified returnable package with the first sorter, the package is given an index which corresponds to the index of the first sorting automaton. Since each sorting automaton may comprise several indexes, each sorter is capable of sorting several different package types.

The package transfers from the identification and measuring point by means of the conveyor 11 to the first sorting automaton $L_1$ and a sensor 20 of the sorter $L_1$ senses the entry of the package. The sorter $L_1$ immediately compares the first identification index in the pushdown storage $M_1$ with its own index, and if they correspond to each other, the sorter performs the sorting and transfers the package away from the main conveyor.

If the read index of the pushdown storage corresponds to no specific index of the sorter, the first data concerned transfers from the pushdown storage $M_1$ of the sorter to the pushdown storage $M_2$ of the next sorter automaton $L_2$, to its first lowermost free storage location $R_1$, $R_2$ . . .

The package is thus transferred further on the main conveyor 11 to the second sorter concerned, and the sensor device 20 of said second sorter $L_2$ senses the entry of the returnable package at the sorter $L_2$ and compares the first identification index of the pushdown storage $M_2$ related to the sorter $L_2$. If a correspondence is observed at least at one specific index, the sorter $L_2$ performs the sorting and transfers the product e.g. to the second conveyor or e.g. directly to a storage station. The identification index is then removed from the storage location $M_2$ of the sorter $L_2$, and it is also not transferred to the pushdown storages $M_1$, $M_2$, $M_3$, $M_4$ . . . of other sorters. If the indexes do not correspond to each other, the identification index stored in the pushdown storage of the sorting automaton and in its first storage location transfers to the first lowermost free storage location $R_1$, $R_2$ . . . of the pushdown storage $M_3$ of the next sorting automaton $L_3$. Thereafter, a corresponding comparison is repeated, when the returnable product, e.g. a bottle, enters at the third sorter $L_3$.

In this way, it is possible to sort an indefinite number of returnable products at a high speed without it being necessary to know the speed of the conveyor or the distances between the sorting stations, etc.

The examples provided above are not meant to be exclusive. Many other variations of the present invention would be obvious to those skilled in the art, and are contemplated to be within the scope of the appended claims.

What is claimed is:

1. A method for sorting returnable bottles, cans and other returnable packages, comprising identifying a returnable package via an identification device comprising a data processing unit and a data storage unit, in which data about different-type acceptable packages are preregistered, and providing said package with an identification index corresponding to the particular package, transferring said package via a conveyor to a first sorter located after said identification device, transferring said identification index to a push down storage of said first sorter, providing said first sorter with a specific index corresponding to an acceptable package for which said sorter will perform a sorting operation, comparing said identification index to the specific index related to said first sorter, performing a sorting operation with said first sorter if said identification index corresponds to said specific index of said first sorter, and if said identification index of said package does not correspond to said specific index of said first sorter, transferring said identification index to lowermost free storage location of a push down storage of one or more subsequent sorters, providing each of said subsequent sorters with a specific index corresponding to an acceptable package for which each of said subsequent sorters will perform a sorting operation, freely transferring each of said sorters to a desired location on said conveyor such that the sorting point is freely selectable, providing each of said sorters with a pair of legs and a connecting frame part connecting said legs such that a gate is formed through which said conveyor is led, providing each of said sorters with a sensor device for detecting the arrival of said package at said sorter, said identification index of said package being compared to said specific index of said sorter upon detection of the arrival of said returnable package at said sorter by said sensor device, providing one of said legs of each of said sorters with an actuator, and transferring said package in said sorting operation by means of said actuator.

2. A method according to claim 1, further comprising performing a sorting by said first sorter if said identification index of the returnable package corresponds to said specific index of said first sorter, and removing said identification index from the storage location of said pushdown storage.

3. A method according to claim 1, further comprising sensing the color of said package by producing a light beam from a light source for said package, and comparing the reflected light beam with the identification signals of the acceptable colors stored in said storage unit of said data processing unit, and if the light reflected corresponds to a color identification signal stored in said storage unit, an index corresponding to said identification is given to said package.

4. A device for sorting returnable bottles, cans or other returnable packages, which device comprises an identification device, said identification device including a data processing unit for identifying and accepting returnable packages, and a storage unit into which data concerning accepted package are preprogrammed, said identification device providing the returnable packages with an identification index, a plurality of sorters for sorting the returnable packages, each of said sorters including a push down storage of a series bus and storage register locations, at least one specific index corresponding to a particular type of returnable package for which said sorter will perform a sorting operation, and a sensor device for detecting the entry of the returnable package at the sorter, a main conveyor structured and arranged to transfer said identified returnable packages from said identification device to a first one of said sorters, and if necessary, to subsequent one of said sorters, each one of said sorters being freely movable to a desired location on said conveyor such that the sorting point of each of said sorters is freely selectable, at least one of said sorters comprising first and second frame parts acting as legs of said sorter, and a connecting frame part connecting said first and said second frame parts, said frame parts forming a gate through which said conveyor is led, said sensor device being located in a space confined by said frame parts of said sorter adjacent to the path of said conveyor, the data from the identification index of a particular one of the returnable packages being transferred to a lowermost storage location of said push down storage of a particular one of said sorters, the identification index of the lowermost storage location of said push down storage being compared to the at least one specific index in said sorter upon detection of the entry of the returnable package at said sorter by said sensor device, said sorter being structured and arranged to perform a sorting operation of said returnable package if the identification index of said push down storage corresponds to the specific index of the sorter, and an actuator for transferring the returnable package to thereby perform the sorting operation.

5. The device of claim 4, wherein if the sorting is not performed with said first sorter, the lowermost index record in the storage register of said first sorter is transferred to a first lowermost free storage location of the storage register of a pushdown storage of a next sorter, whereby a comparison is performed between the index data of and the specific index of the sorter at said sorter at a step when the package related to the index has entered at said second sorter.

6. The device of claim 5, wherein each of said sorters includes at least two specific indexes, such that each of said sorters is adapted to sort different types of packages.

7. The device of claim 4, wherein said conveyor comprises one or more belt conveyors.

8. The device of claim 4, wherein said conveyor is structured and arranged to transfer the returnable packages horizontally along the width of said conveyor.

9. The device of claim 4, wherein said identification device comprises a stationary illuminator of illuminating the returnable packages and a detector for monitoring the returnable package.

10. The device of claim 9, wherein said detector is a line camera.

11. The device of claim 4, wherein said identification device is programmed to measure the height of the returnable package.

12. The device of claim 4, wherein said actuator is a solenoid or actuating cylinder.

* * * * *